United States Patent [19]

Coulombe et al.

[11] 3,970,019

[45] July 20, 1976

[54] THREADING APPARATUS FOR SEWING MACHINES

[75] Inventors: Lionel J. Coulombe, Matawan; Anthony Giaimo, Staten Island, both of N.Y.

[73] Assignee: The Singer Company, New York, N.Y.

[22] Filed: Dec. 12, 1975

[21] Appl. No.: 640,085

[52] U.S. Cl. ..... 112/245; 112/254

[51] Int. Cl.[2] ..... D05B 49/00

[58] Field of Search ..... 112/245, 254, 241, 242

[56] References Cited

UNITED STATES PATENTS

| | | | |
|---|---|---|---|
| 2,462,812 | 2/1949 | Parry et al. | 112/254 X |
| 2,962,992 | 12/1960 | Johnson et al. | 112/254 X |
| 3,654,883 | 4/1972 | Reimer et al. | 112/245 |

*Primary Examiner*—George H. Krizmanich

*Attorney, Agent, or Firm*—Edward L. Bell; Robert E. Smith; Julian Falk

[57] ABSTRACT

This disclosure relates to threading apparatus for sewing machines and in particular to a movable thread engaging means disposed in proximity to a disc-type tension device which thread engaging means is operative during movement of the tension discs towards one another for guiding the thread between and in operative relationship with the tension discs so as to ensure that the thread will be properly threaded through the tension device.

7 Claims, 4 Drawing Figures

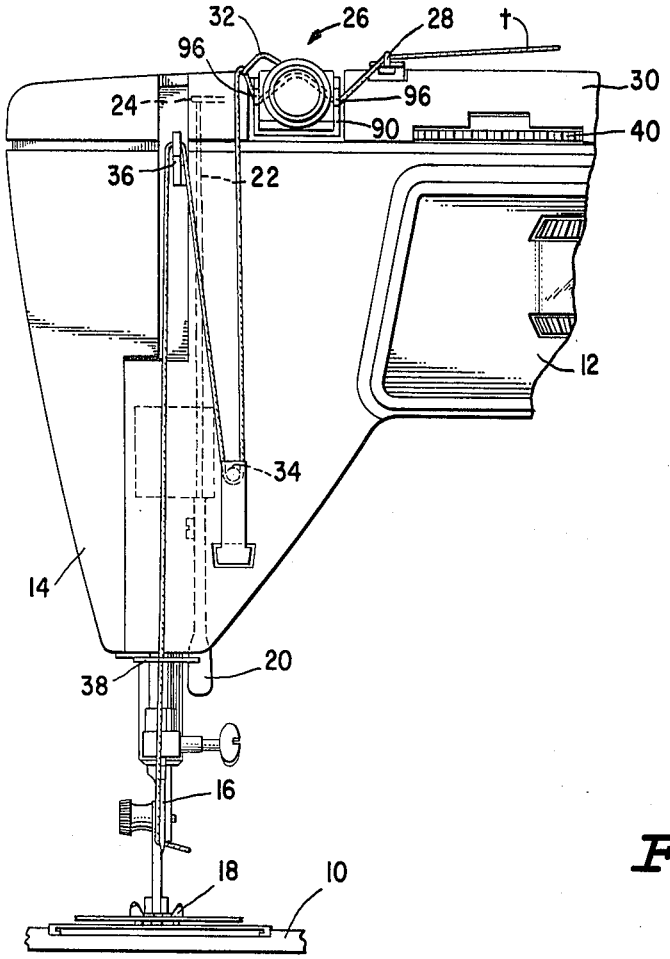
Fig. 1
Fig. 3
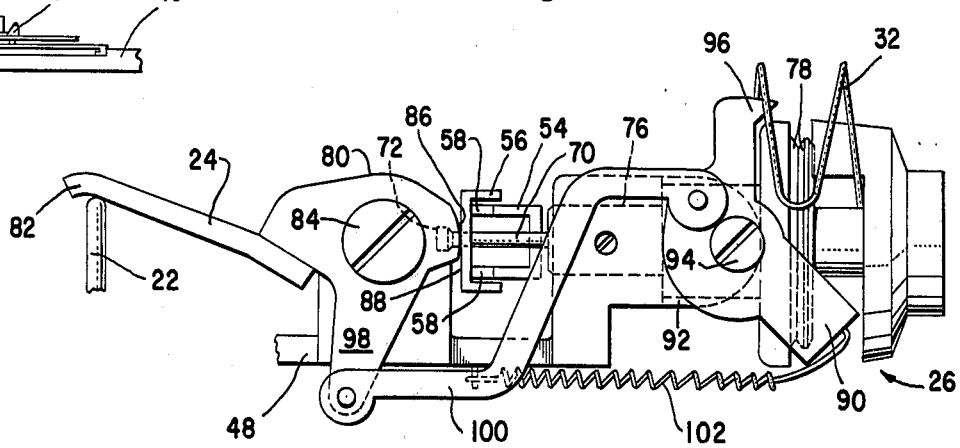
Fig. 4
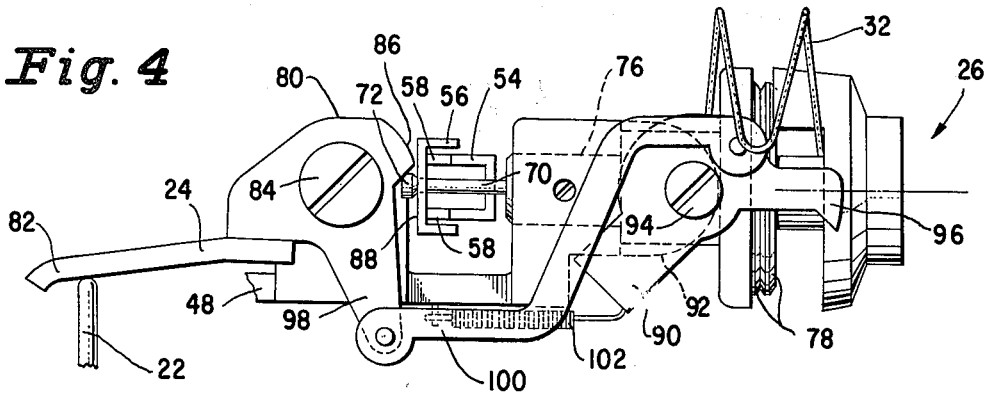

THREADING APPARATUS FOR SEWING MACHINES

BACKGROUND OF THE INVENTION

When threading a sewing machine the needle thread is usually directed from a source of supply such as a spool or the like through thread guides, a thread tensioning device, a thread take-up mechanism and finally to the needle. The tension device itself generally includes a plurality of thread friction washers or discs between which the thread is placed during operation of the sewing machine. The thread friction discs may be spring biased towards one another with the spring pressure being adjustable so that the tension on the thread may be varied. The thread upon leaving the thread supply may pass through a stationary thread guide, between the tension discs and through a check-spring which may be carried by the tension device itself. Such an arrangement is shown in U.S. Pat. No. 3,667,414 granted June 6, 1972. As also disclosed in the aforementioned patent, the tension device may be operatively connected with the presser bar mechanism so that when the presser bar is lifted the presser foot is raised above the work and the tension will be released in the tension device and when the presser foot is lowered by the presser bar mechanism the tension will be restored in the tension device.

When the tension is released in the tension device so that the discs are relatively spaced apart and the thread is thereby free to move with respect to the discs, a problem arises that the thread may leave its operative position with respect to the tension discs and when tension is restored in the tension device the thread will not be properly disposed within the tension device which may result in an undesirable sewing operation. This problem may occur more frequently in a situation wherein the presser bar is raised along with the presser foot and in combination with the tension device the tension is released in the tension device thereby relieving any tension or pressure on the thread. Since the thread is free to move at this time and since the action of a thread having previously been under tension is somewhat unpredictable, the thread may move to a position where it is not properly disposed within the tension device. Unless the operator is aware of such condition, when the presser mechanism is lowered, the thread may not be properly disposed within the tension device thus giving rise to a situation wherein the tension device has no effect on the thread and a possible defect in the resulting stitching.

It is a purpose of the present invention to overcome the problem of possible unwanted unthreading of the thread from the tension device during operation of the presser bar mechanism.

GENERAL DESCRIPTION OF THE INVENTION

As briefly stated above, it is a prime purpose of the present invention to overcome the problem of possible unthreading of the thread from the tension device during operation of the presser bar mechanism. In accordance with the present invention means are provided in proximity to the tension device for positively placing the thread between the tension discs during the lowering of the presser mechanism and the consequent restoration of tension in the tension mechanism. In the preferred embodiment of the invention such means comprises a pair of thread engaging fingers which are disposed in close proximity to the tension device, one on each side thereof, which thread engaging fingers are carried by a pivotal member which is operatively connected to the presser mechanism and is responsive to lowering of the presser mechanism for engaging the thread and drawing it into position between the thread tension discs. As will be more clearly understood from the following detailed description, the construction of the present invention solves the problem of losing proper thread engagement in the tension device during operation of the presser mechanism by providing a positive means to position the thread in the tension device for the sewing operation.

DESCRIPTION OF THE DRAWINGS

The preferred embodiment of the invention will be best understood by referring to the following detailed description with the accompanying drawings wherein:

FIG. 1 is a front view of a portion of a sewing machine illustrating the present invention, FIG. 3 is a side view of the tension mechanism illustrated in FIG. 2 illustrating the present invention in a non-thread engaging position, and FIG. 4 is a view similar to FIG. 3 showing the present invention in the thread engaging position.

DETAILED DESCRIPTION OF PREFERRED EMBODIMENT

Figure 2:
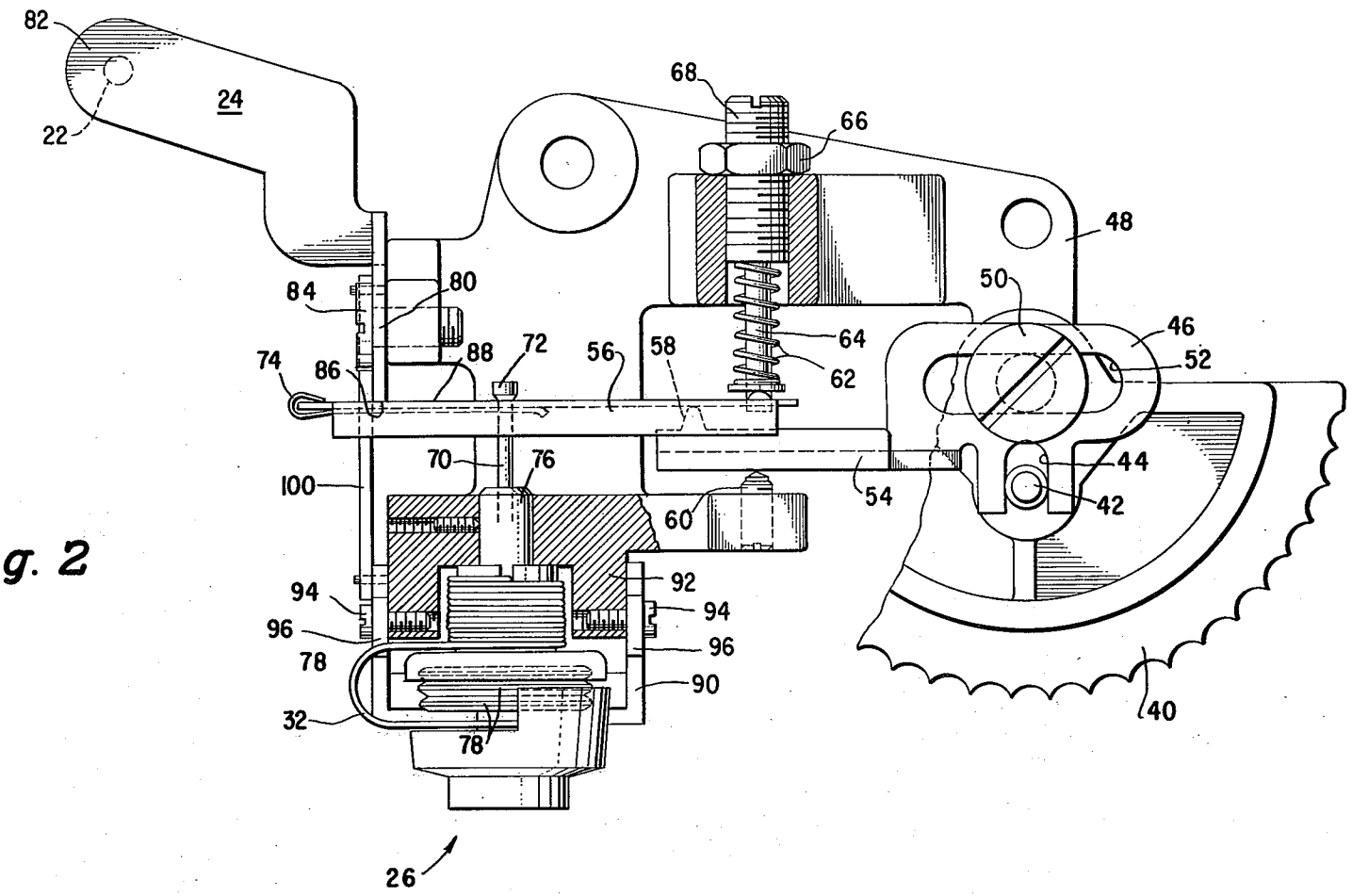
FIG. 2 is a top plan view of the tension mechanism of the sewing machine illustrated in FIG. 1 with the present invention incorporated therein.

Referring to FIG. 1, a portion of a sewing machine is illustrated therein as including a bed 10, an arm 12 which overhangs the bed 10 and terminates in a sewing machine head 14. The arm 12 and head 14 are hollow and, as is well-known in the art, are provided with mechanism (not shown) for reciprocating the sewing machine needle 16 for penetrating the work with a needle thread "*t*". A presser foot 18 is also provided for holding down the work during the sewing operation which presser foot 18 is connected to a presser bar mechanism for raising and lowering the presser foot as is well-known in the art. The presser bar mechanism for raising and lowering the presser foot 18 is not illustrated but may be of any well-known type such as illustrated in U.S. Pat. No. 954,858 issued Apr. 12, 1910, and U.S. Pat. No. 2,440,615 issued Apr. 27, 1948. For purposes of the present invention the presser bar mechanism is illustrated in part as comprising a lever or handle 20 which is pivotably mounted to the rear portion of the sewing machine head and is connected to a lever mechanism for raising and lowering the presser bar. Presser bar lever 20 is also operatively connected to an upstanding rod 22, shown in phantom in FIG. 1, which is operatively connected at its upper end to a lever 24 (see FIGS. 1 – 4) which in turn is associated with the tension mechanism so that when the lever 20 is lifted the rod 22 will be raised to engage the lever 24 for releasing the tension in the tension mechanism 26 as will be more fully understood hereinafter. In threading the sewing machine illustrated in FIG. 1 the thread "*t*" is drawn off a supply spool (not shown) and passes through a stationary thread guide 28 on the cover plate 30, in one side of the tension device 26 and out the other side, and through a check-spring thread guide 32 which is part of the tension device 26, then to a stationary thread guide post 34 disposed below the tension device 26, to a take-up member 36 which is part of the take-up mechanism, through a stationary thread guide 38 on the lower part of the head 14 and then through the needle 16.

The tension mechanism itself is generally of the type illustrated and described in U.S. Pat. No. 3,667,414 issued June 6, 1972 and reference may be had to said patent for the details of the tension mechanism. The tension mechanism in general comprises an adjusting dial member 40 which is pivotably supported to the cover plate 30 and carries a pin 42 disposed in a slot 44 in a linearly movable bracket 46 which is in turn carried on the tension device main support bracket 48 by a screw 50 passing through a slot 52 in the bracket 46. As further shown in FIG. 2, the bracket 46 includes an extending slide portion 54 which slides within a U-shaped lever 56 and includes a projection 58 which bears against the inner surface of the bottom portion of the U-shaped lever 56. The slide member 54 bears against an adjustable set screw 60 on one side thereof, as illustrated, which regulates the maximum distance to which the slide member 54 can move in a direction away from the lever 56. The lever 56 is spring biased toward the slide 54 by a spring 62 disposed on a fixed shaft 64 supported in a portion of the bracket 48, as illustrated, and which may be adjusted by means of the nut 66 disposed on the threaded portion of the shaft 68. The lever 56 is provided with an aperture therein through which passes a rod 70 having a head portion 72 disposed at its extremity, which is disposed adjacent the outer surface of the lever 56, as illustrated, and which is captured with the lever 56 by a spring clip 74. The rod 70 passes through a bore in a shaft 76 supporting the tension discs 78 and is operatively connected to the tension discs 78 to apply a tension force thereon when the rod is shifted axially away from the tension discs. As will be apparent, when the dial 40 is turned to the left as viewed in FIG. 2, the bracket 46 and the slide 54 will be shifted to the left by virtue of the pivoting arrangement and will slide the projection 58 to the left within the lever 56 and fulcrum the lever 56 in a direction away from the tension discs 78. In thus moving the lever 56 in this direction the rod 70 will be moved axially outwardly away from the tension discs thereby drawing the tension discs toward each other to apply greater tension or friction pressure on a thread passing therethrough. For a greater understanding of the specific structure of the tension device thus far described, again reference may be made to U.S. Pat. No. 3,667,414 referred to above. For purposes of the present invention it need only be understood that when the lever 56 is moved axially outwardly away from the tension discs carrying the rod 70 therewith the discs 78 will be drawn closer together and when the lever 56 is moved in the opposite direction or toward the discs 78 the distance between the discs 78 will increase.

As also described in the aforementioned U.S. Pat. No. 3,667,414 the lever 24 is associated with the presser bar mechanism so that when the presser bar is raised the tension in the tension mechanism will be released. As shown in FIGS. 1 – 4, the rod 22 connected operatively to the presser bar lever 20 is disposed for operative engagement with the lever 24 to initiate a raising motion thereto when the lever 20 is raised. As shown in FIGS. 2 – 4, the lever 24 is supported on the bracket 48 for pivotal motion relative thereto and is provided with a cam portion 80 disposed at right angles to the finger-like portion 82 of the lever 24 which operatively engages the rod 22. The cam portion 80 is pivotally supported on the bracket 48 by means of a screw 84 or the like and has a cam surface 86 which bears against the rear wall 88 of the slide 56 when the arm 82 is in a raised position as illustrated in FIG. 3. When the arm 82 is in such raised position and the cam portion 86 bears against the wall 88 of the lever 56, the lever 56 is forced inwardly toward the discs 78 against the fulcrum pressure provided by the slide 54 thereby cancelling the force applied to the lever 56 by the slide and thus releasing the axial force on the rod 70. Therefore, when the arm 82 is in the raised position the tension or force on the rod 70 will be released and will permit the rod 70 to move axially inwardly toward the tension discs thus relieving the pressure between said tension discs and as a result will release the tension on the thread passing between said discs. It will be apparent therefore that each time the presser bar mechanism lever 20 is raised that the arm 82 will be raised to cam the lever 56 thereby resulting in a release of tension in the tension device as heretofore described.

As briefly described above, when the tension is released in the tension device the friction on the thread is at a minimum and the thread is therefore free to move from between the tension discs. The thread having previously been under tension by the tension device may possess spring-like qualities due to the various characteristics inherent in thread itself and when the tension is released the thread may react to spring out of engagement with the tension discs. When the presser bar mechanism is later lowered to restore tension in the tension device the thread may not be in a proper position to be engaged between the tension discs and therefore control of the tension on the thread will be lost. The construction of the present invention overcomes this problem.

As shown in the drawings, a U-shaped bracket 90 is disposed in surrounding disposition relative to the tension mechanism 26 and is pivotably supported to the legs of the U-shaped portion 92 of the bracket 48 by screws 94 (see FIG. 2). The bracket 90 is formed with a pair of thread engaging fingers 96, one disposed on each side of the tension discs 78, as illustrated in FIG. 2, and has a length such that when they are pivoted to the position illustrated in FIG. 4 they will overlie the opening in the tension device through which the thread passes for engagement with the tension discs 78. The cam portion 80 of the lever 84 also is provided with a projection or finger-like portion 98 and pivotably carried on the end thereof by a pin is an S-shaped lever 100 which is pivotably connected to the U-shaped bracket 90 by a pin at its other end thereof, but at a point off center from the pivot connection for the bracket 90. A spring 102 is connected at one end to the U-shaped bracket 90 and is fixed at its other end to the bracket 48 and acts to bias the U-shaped bracket 90 to pivot toward the position illustrated in FIG. 4 or the down position. As seen in FIG. 3, when the arm 82 of the lever 24 is raised by lifting the presser bar lever 20, the cam portion 80 of the lever 24 will be pivoted clockwise which motion will be transmitted through lever 100 to the U-shaped bracket 90 to pivot the bracket 90 in a counter-clockwise direction due to the off center pivot connection and raise the thread engaging fingers out or away from the thread engaging position. When the presser bar mechanism is lowered through the lever 20 the arm 82 will move downwardly and pivot the cam portion 80 in a counter-clockwise direction thus pivoting the thread engaging fingers in a clockwise direction.

As described above, when the tension mechanism is in a tension release condition such as that illustrated in FIG. 3, the thread will be disposed in a loose disposition relative to the tension discs and through the check-spring 32. The arrangement of the structure of the invention is such that as the presser bar mechanism is lowered the thread engaging fingers will be pivoted to engage the thread prior to the closing of the tension discs and force the thread between the tension discs while the tension discs are moving toward a closed position (see FIG. 1). As further seen in FIG. 4, when the thread engaging fingers 96 are pivoted to the thread engaging position or the closed tension position the thread engaging portion of the fingers 96 will pass beyond the centerline of the shaft 76 carrying the tension discs 78. As further seen in FIG. 1, when the thread is engaged by the fingers 96 the thread will straddle the tension discs just below their centerline to ensure a positive disposition of the thread for operative engagement with the tension discs.

It will be seen from the above detailed description that a mechanism is provided for ensuring positive engagement of the needle thread for disposition between the discs of the tension device each time the presser mechanism is lowered into its operative position. By this means the operator need not be concerned that the tension mechanism is properly threaded each time the presser mechanism is operated which may occur often during the sewing operation. The mechanism of the invention is relatively simple in construction and may be readily adapted to discs type tension mechanisms without requiring a major reconstruction of the sewing machine itself. While the invention has been described in its preferred embodiment, it will be apparent that those skilled in the art that various changes and modifications may be made therein without departing from the spirit and scope of the invention as defined in the appended claims.

Having thus described the nature of the invention, what we claim herein is:

1. In a sewing machine, a tension device including spaced friction discs for applying frictional resistance to movement of a thread therebetween, presser means including means for raising and lowering the presser means responsive to raising and lowering said presser means for initiating movement of said discs toward and away from each other, the improvement comprising, movable thread engaging means disposed in proximity to said tension device, said thread engaging means being operative when said discs are moved toward each other for guiding the thread between and in disposition for operative engagement with said discs.

2. In a sewing machine as recited in claim 1 wherein said thread engaging means is operatively connected to said presser means such that when said presser means is lowered movement of said thread engaging means is initiated for guiding the thread between said discs.

3. In a sewing machine as recited in claim 1 wherein said thread engaging means comprises finger means disposed for movement relative to said tension device between a first raised position wherein said finger means is ineffective for guiding the thread between said discs and toward a second lowered position wherein said finger means is effective for guiding the thread between said discs.

4. In a sewing machine as recited in claim 3 wherein said finger means comprises a pair of thread engaging fingers with one of said fingers being disposed on each side of said tension device.

5. In a sewing machine as recited in claim 4 wherein said thread engaging fingers are supported for pivotal movement relative to said tension device.

6. In a sewing machine as recited in claim 5 wherein said presser means includes means for initiating pivotal movement of said fingers.

7. In a sewing machine as recited in claim 5 further comprising common support means for said fingers, link means operatively connecting said common support means to said presser means such that when said presser bar means is lowered movement of said fingers is initiated toward said second lowered position.

* * * * *